United States Patent [19]

Welch

[11] Patent Number: 4,545,489

[45] Date of Patent: Oct. 8, 1985

[54] STORAGE RACK

[76] Inventor: Stephen R. Welch, 1227 S. Wilke Rd., Arlington Hts., Ill. 60005

[21] Appl. No.: 485,407

[22] Filed: Apr. 15, 1983

[51] Int. Cl.[4] ..... A47F 7/00

[52] U.S. Cl. ..... 211/11; D19/86; 211/69.8; 211/120

[58] Field of Search ..... 211/50, 51, 69.8, 69.1, 211/120, 45, 11; D19/86, 90; 248/316.9, 126

[56] References Cited

U.S. PATENT DOCUMENTS

| | | | |
|---|---|---|---|
| 231,969 | 9/1880 | Perkins | 211/69.8 |
| 1,429,846 | 9/1922 | Coutts . | |
| 1,508,680 | 9/1924 | Daniels | 211/120 |
| 1,783,840 | 12/1930 | Goeller | 211/89 |
| 1,822,734 | 9/1931 | Harrington | 211/120 |
| 2,073,172 | 3/1937 | Posnack | 211/51 X |
| 2,202,267 | 5/1940 | Posnack | 211/69.8 X |
| 2,530,307 | 11/1950 | Leach | 211/120 |
| 3,079,724 | 3/1963 | Harvel et al. | 248/316.9 |
| 4,176,752 | 12/1979 | Taber . | |

*Primary Examiner*—Robert W. Gibson, Jr.

*Attorney, Agent, or Firm*—Wood, Dalton, Phillips, Mason & Rowe

[57] ABSTRACT

A storage rack for desk top or wall use is disclosed. A plurality of resilient strips define expanded adjacent loops. A contact area is defined between adjacent loops. The loop-forming strips are joined to each other at a common point, and the resulting structure is secured to a flat base which permits the suspension of the rack from a wall or placement upon a horizontal surface. The arrangement of the strips causes a substantial frictional force to be developed between the loops whereby objects can be firmly retained between the loops.

10 Claims, 5 Drawing Figures

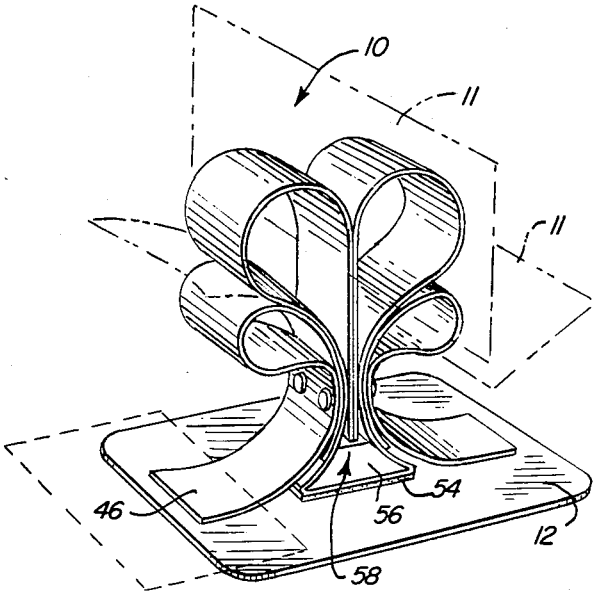
FIG. 1
FIG. 2
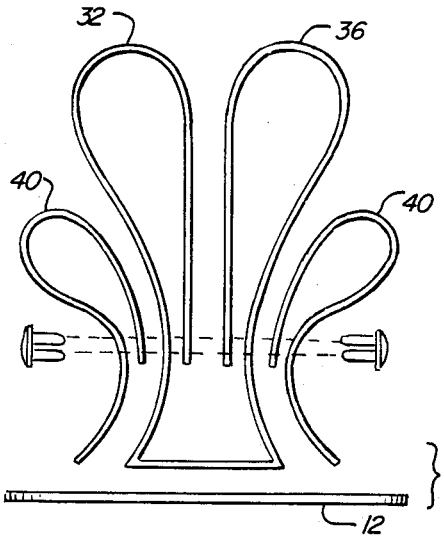
FIG. 3
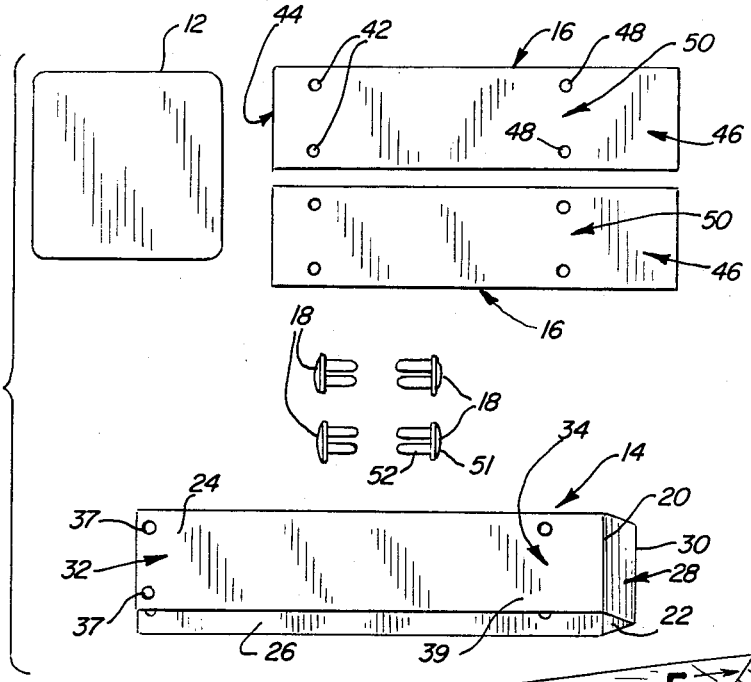
FIG. 4
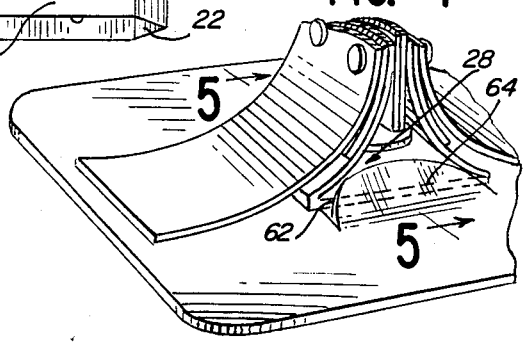
FIG. 5
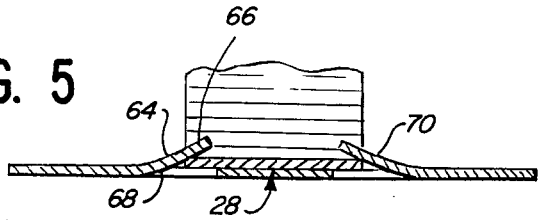

STORAGE RACK

BACKGROUND OF THE INVENTION

Desk organizers for paper, files or the like have taken a variety of forms. A prior structure is one consisting of a flat base and a plurality of spaced upright dividers extending from the base and defining compartments for the reception of materials.

The construction described above has numerous drawbacks. First of all, the dimension of the compartments defined by the partitions is generally fixed. Thus, if a single sheet of paper or thin matter is disposed in the compartment, it will not be securely held and might escape from the holder.

Another drawback with the above design is that it is generally fairly expensive to manufacture. The structure may be molded as a unit or require substantial assembly at the factory. The completed article is generally shipped in an assembled state and may be quite bulky. Consequently storage and shipping costs can be substantial.

An alternative design is disclosed in U.S. Pat. No. 4,176,752, to Taber, and specifically in FIG. 13. In Taber, a rigid L-shaped base is provided to which a continuous strip of flexible, resilient plastic material is attached. The material is shaped to form a series of loops progressively varying in size, with the loops anchored in spaced positions along the base. To maintain the configuration of the loops and to develop a compressive force between successive loops, a resilient foam material fills the voids within and expands the loops. Objects are frictionally maintained between adjacent loops.

Several of the drawbacks in the previous construction are also apparent in the Taber structure. The construction of the rack is fairly complex in that the loops must be anchored in several spots across the extent of the base. To anchor the strip, one must work between the numerous loops which is a tedious operation. Further, after assembling the strip with the base, a separate operation must be performed to fill the voids with the foam, without which the invention would be ineffective. As the manufacturing becomes increasingly complicated, the attendant costs rise proportionally. Because the assembly of the Taber rack is complicated, preassembly is dictated. The rack is quite bulky and as with the prior construction, represents a substantial investment in storage and shipping.

The present invention is directed specifically to overcoming the problems enumerated above.

SUMMARY OF THE INVENTION

A storage rack according to the present invention comprises a plurality of resilient strips each folded against itself in a contact area to define an expanded loop. The contact areas of the strips are closely and successively joined with each other, bringing adjacent loops into intimate contact with each other. The joined strips are supported on an expanded base.

It is the principal object of the present invention to afford a storage rack that is simple, inexpensive and lightweight and that affords a structure to securely retain files, papers, or other objects.

In a preferred form the base and strips are made from sheets of lightweight plastic and have a substantially rectangular configuration. The manufacture of the base, as well as the strips, involves a simple cutting operation performed on a plastic sheet. Each of the strips preferably has at least two apertures spaced lengthwise of each other and coinciding in the contact area with the strip folded to define its respective loop. The apertures from all the joined loops are aligned so that a fastener such as a rivet can be extended through.

The invention permits any combination of loop size and number. By assembling the strips at a common area, a compressive force is developed between adjacent loops so that inserted objects are firmly and frictionally retained. As the strips are successively joined, the loops deflect progressively from the vertical. The deflection of the successive loops amplifies the compressive forces between the strips.

In its preferred form, the storage rack performs a dual function. One strip is provided with at least two fold lines spaced longitudinally and arranged transverse to the length of the strip. The fold lines define first and second lengths of the strip with an intermediate mounting area through which the strip is connected with the base. The first and second lengths are folded about themselves and anchored to define cooperating loops. To secure the strip with the flat base, a pressure sensitive adhesive layer is located between the base and the mounting area. Additional loops can be mounted outside the main strip according to the invention as space permits.

Alternatively, the base is provided with two bendable tabs which cooperatively capture the mounting area. In a preferred form, the tabs are struck directly from the base and formed by two semicircular slits opening oppositely from one another.

Because the compressive force between adjacent loops is substantial, the storage rack will maintain objects even when suspended from a wall as well as upon a horizontal surface. The mounting area defines in conjunction with the first and second lengths of the strip extending away from the mounting area, a triangular space which is suitable to support pens and pencils or other elongate objects, with the rack wall mounted.

It is another distinct advantage of the present invention that the entire rack can be shipped as a flat unit and readily assembled by the purchaser. The strips and base can be positioned in overlapping relationship and fit within an envelope for shipping. Assembly involves merely forming the loops from the strips and advancing a fastener through the aligned apertures to maintain the strips in assembled relationship. The joined strips can then be mounted with the base either adhesively or by deflecting the tabs on the base and engaging the mounting area of the main strip. Consequently, assembly costs are avoided by the manufacturer and shipping and storage costs substantially reduced.

DETAILED DESCRIPTION OF THE DRAWINGS

FIG. 1 is a perspective view of a preferred form of the storage rack in an assembled state;

FIG. 2 is an exploded view of the storage rack in FIG. 1;

FIG. 3 shows the unassembled elements making up the storage rack in FIG. 1;

FIG. 4 is an enlarged, fragmentary, perspective view of an alternative mounting for the base of the rack;

FIG. 5 is a fragmentary sectional view of the mounting taken along line 5—5 of FIG. 4.

DETAILED DESCRIPTION OF THE DRAWINGS

Referring initially to FIG. 1, a preferred form of the invention is disclosed and includes generally a plurality of joined strips 10 defining loops between which flat objects such as letters 11 or the like are frictionally retained, and a flat base 12 to which the joined strips 10 are secured.

The elements making up the storage rack in FIG. 1 are shown in an unassembled state in FIG. 3 and comprise a central strip 14, two identical additional strips 16, the base 12 which is generally square, and four mating rivet halves 18. The base 12, central strip 14, and strips 16 are all preferably cut from a flat sheet of resilient plastic.

The central strip has a rectangular configuration and first and second fold lines, 20 and 22 respectively, intermediate and transverse the length of the central strip 14. The fold lines 20, 22 define first and second strip lengths 24, 26 and an intermediate mounting area 28. Preferably, the first and second fold lines are located so that the dimension of the first and second lengths is substantially equal and the resulting loop configurations approximately the same.

Intermediate the first and second fold lines is an optional transverse fold line 30 situated preferably to divide the central strip 14 in half. This optional fold line 30 is provided to facilitate flattening of the mounting area 28 which facially engages the base. Without the fold line 30 the mounting area tends to bow. Further, the optional line permits reduction of the folded length of the central strip, which is otherwise folded about one of either the first or second fold lines. The fold lines 20, 22, 30 may be formed by scoring, molding, or creasing the strip 14 or in any other suitable manner.

Assembly of the storage rack is initiated by forming the central strip. The free end 32 of the first length 24 is folded back toward the first fold line 20 and against itself in a contact area 34 so as to define a main loop 36 as in FIG. 2. A pair of laterally spaced apertures 37 are provided at the free end and coincide with apertures 39 in the contact area 34 with the length 24 folded. The second strip length 26 is similarly formed to provide an additional loop 38 intimately contacting the adjacent loop 36 along its height. The length of the central strip 14 and the location of the apertures 37, 39 determine the size of the loops. The compressive force between adjacent loops 36, 38 depends on the size of the loops as well as the resilience and thickness of the strip material. Preferably, the loops, when formed in the central strip 14 are sufficiently expanded that the adjacent loops 36, 38 are in intimate contact and deflected slightly away from each other.

While the invention is operable with a single central strip as described, the invention also contemplates the provision of additional loops 40 formed from the strips 16 and cooperating with the loops 36, 38 to afford additional storage capability. The strips 16 likewise have laterally spaced apertures 42 adjacent one end 44 which is folded back toward the opposite end 46 to align a separate set of apertures 48 in a contact area 50. The loops 40 defined by the additional strips are not as expansive as the main loops 36, 38, though the particular size of the loops is optional. The strips 16 defining the loops 40 are then situated against the main loops 36, 38 to align the apertures 37, 39, 42, 48. The rivets 18 are then inserted to closely join the contact areas 34, 50 with each other.

A suitable fastener for the strips is the Ratchet Rivet manufactured by Fastex. The rivet consists of identical mating halves each with an enlarged head 51 integrally formed with serrated prongs 52. The entire rivet is preferably fabricated from nylon. The mating halves are advanced toward each other and will interlock anywhere along the prongs to adjust the spacing between the heads 51. Thus the user need only insert one rivet half 18 through the aligned apertures in the strips 14, 16 and mate the other rivet half by press fitting. The strips are thereby maintained closely against each other in the contact areas 34, 50.

To assemble the joined strips with the base 12 a pressure sensitive adhesive layer is disposed between the base 12 and the mounting area 28 on the central strip 14. With the joined strips 10 secured with the base 12, the free end 46 of each strip 16 will overlie the base and is resiliently urged thereagainst. Flat objects can be placed between the free ends 46 and the base 12 for additional storage.

As seen most clearly in FIG. 1, the inside surface 56 of the mounting area 28, in conjunction with the first and second lengths 24, 26 extending away from the mounting area as far as the contact areas, define a triangular pocket 58 into which can be inserted pens, pencils or other elongated objects to support the same with the rack wall mounted.

An alternative mounting to the adhesive layer 54 in the embodiments in FIGS. 1 and 2 is shown in FIGS. 4 and 5. The strips 14, 16 are joined as previously described. The base 12 is modified with two stamped, semicircular slits 62 extending through the base and opening away from each other. The slits 62 define two tabs 64 that can be pressed upwardly and out of the plane of the base 12. The tabs 64 are spaced to cooperatively capture the mounting area 28 to retain the joined strips 10 upon the base. The joined strips 10 are positioned by inclining the mounting area and seating it beneath one of the tabs 64. The edge 66 at one end of the mounting area is forced as far as possible toward the bend 68 in the tab. The opposite tab 64 is then bent upwardly sufficiently to allow clearance of the opposite edge 70 of the mounting area. With the mounting area 28 seated against the base 12, the restoring force in the tabs 64 urges the mounting area closely against the base 12.

The foregoing detailed description is made for purposes of illustration and no unnecessary limitations are to be understood therefrom, as modifications within the scope of the invention will be obvious to those skilled in the art.

I claim:

1. A storage rack comprising:

a plurality of resilient strips each returned against itself in a contact area to define an expanded loop with a closed end at the contact area;

means for securing the closed ends of said strips to one another so that each loop has facial engagement over a substantial area with at least one adjacent loop, each of the strips being secured to other strips only at the closed loop end; and means for supporting the strips at said closed ends, whereby objects can be inserted and firmly, frictionally retained between the facially engaged portions of adjacent loops.

2. The storage rack of claim 1 wherein said securing means comprises at least one fastener extending through aligned apertures in the strips at said closed ends.

3. The storage rack of claim 1 wherein each said strip has a substantially rectangular configuration.

4. A storage rack comprising:

an elongate strip of resilient material;

longitudinally spaced, preformed first and second fold lines in the elongate strip extending transversely to and intermediate the opposite ends of the strip to facilitate folding of the strip about the fold lines in a predetermined fashion, said fold lines defining first and second opposite distal end portions of said strip and a mounting area between said first and second fold lines, each of said first and second end portions being looped outwardly from the fold line and returned back against itself at a contact area to define an expanded closed loop;

means closely joining said contact areas of the first and second end portions to each other; and means for supporting said mounting area, whereby objects can be frictionally retained between said loops formed by the first and second end portions.

5. The storage rack of claim 4 wherein said supporting means comprises a base which is substantially flat and a pressure sensitive adhesive is disposed between the mounting area and the base to connect the strip with the base.

6. The storage rack of claim 4 wherein said mounting area in conjunction with the first and second end portions adjacent thereto defines a substantially triangular space suitable for the storage of pens, pencils, or the like.

7. The storage rack of claim 4 wherein said supporting means comprises a base which is a substantially flat member and a plurality of spaced tabs are associated with the base and cooperatively capture the mounting area to connect the strip to the base.

8. The storage rack of claim 4 wherein at least one additional, flexible strip is looped so as to define a loop and means are provided to secure said additional strip to the base so that the loop of said additional strip is in intimate contact with one of the loops defined by the first and second end portions to afford additional storage capability.

9. The storage rack of claim 7 wherein the tabs are formed integrally with the base by at least two spaced, curved slits extending through the base and opening away from each other.

10. A storage rack comprising:

an elongate strip of resilient material;

longitudinally spaced, preformed first and second fold lines in the elongate strip extending transversely to and intermediate the opposite ends of the strip to facilitate folding of the strip about the fold lines in a predetermined fashion, said fold lines defining first and second opposite distal end portions of said strip and a mounting area between said first and second fold lines, said mounting area being provided with a third fold line intermediate said first and second fold lines, each of said first and second end portions being looped outwardly from the fold line and returned back against itself at a contact area to define an expanded closed loop;

means closely joining said contact areas of the first and second end portions to each other; and means for supporting said mounting area, whereby objects can be frictionally retained between said loops formed by the first and second end portions.

* * * * *